US011785682B2

(12) United States Patent
Panjer

(10) Patent No.: US 11,785,682 B2
(45) Date of Patent: Oct. 10, 2023

(54) STIRRER DRIVE SHAFT WITH VENTILATION

(71) Applicant: Koninklijke Fabriek Inventum B.V., Nieuwegein (NL)

(72) Inventor: Frederik A.s. Panjer, Maarsbergen (NL)

(73) Assignee: B/E Aerospace, Inc., Winston Salem, NC (US)

( * ) Notice: Subject to any disclaimer, the term of this patent is extended or adjusted under 35 U.S.C. 154(b) by 440 days.

(21) Appl. No.: 17/164,700

(22) Filed: Feb. 1, 2021

(65) Prior Publication Data

US 2022/0248510 A1 Aug. 4, 2022

(51) Int. Cl.

| | |
|---|---|
| ***H05B 6/74*** | (2006.01) |
| ***H05B 6/70*** | (2006.01) |
| ***B01F 27/07*** | (2022.01) |

(52) U.S. Cl.

CPC ..... *H05B 6/745* (2013.01); *B01F 27/07* (2022.01)

(58) Field of Classification Search

CPC ..... B01F 27/07; H05B 6/745

USPC ..... 219/678, 739, 746, 751, 756, 757

See application file for complete search history.

(56) References Cited

U.S. PATENT DOCUMENTS

| | | | | |
|---|---|---|---|---|
| 4,019,010 A * | 4/1977 | Tanaka | H05B 6/705 | 219/746 |
| 5,568,803 A * | 10/1996 | Brown | F24C 15/322 | 432/199 |
| 7,012,228 B1 * | 3/2006 | Eke | H05B 6/704 | 219/757 |

FOREIGN PATENT DOCUMENTS

| | | |
|---|---|---|
| CN | 207604858 U | 7/2018 |
| WO | WO-2019138333 A1 | 7/2019 |

* cited by examiner

*Primary Examiner* — Quang T Van

(74) *Attorney, Agent, or Firm* — Locke Lord LLP; Joshua L. Jones; Gabrielle Gelozin

(57) ABSTRACT

A stirrer shaft for a microwave oven includes a shaft body configured to connect between a stirrer motor on a first end of the shaft body, and a set of stirrer blades spaced apart from the stirrer motor. The stirrer body includes a flow passage therethrough for equalizing pressure in a sealed stirrer cavity of the microwave oven.

15 Claims, 2 Drawing Sheets

STIRRER DRIVE SHAFT WITH VENTILATION

BACKGROUND

1. Field

The present disclosure relates to aircraft microwave ovens, and more particularly to stirrer assemblies within a microwave oven.

2. Description of Related Art

Microwave ovens can have a cavity plate upon which the food for cooking is placed. In some configurations, rather than set the food for cooking on a rotating plate, instead there can be a reflective stirrer blade in a cavity below the cavity plate. In aircraft, this cavity plate can present design challenges. For example, the cavity must be sealed but an aircraft microwave oven undergoes pressure changes as the cabin pressure changes during a flight. The sealing on the cavity plate can be compromised as cabin pressure changes. Other aircraft-related issues for the sealing of cavity plates include turbulence, which can displace the cavity plate and compromise the seal.

The conventional techniques have been considered satisfactory for their intended purpose. However, there is an ever present need for improved systems and methods for improved ventilation within an aircraft microwave oven. This disclosure provides a solution for this need.

SUMMARY

A stirrer shaft for a microwave oven includes a shaft body configured to connect between a stirrer motor on a first end of the shaft body, and a set of stirrer blades spaced apart from the stirrer motor. The stirrer body includes a flow passage therethrough for equalizing pressure in a sealed stirrer cavity of the microwave oven.

The flow passage can include an outlet at a second end of the stirrer motor opposite the first end. The outlet can open in an axial direction defined by an axis of rotation of the shaft body. The flow passage can also include at least one inlet spaced apart from the outlet. The at least one inlet can be closer to the second end than to the first end. Each of the at least one inlets can open in a radial direction relative to the axis of rotation.

A stirrer assembly for a microwave oven can include the stirrer shaft as described above, a stirrer motor connected to a first end of the shaft body, and a set of stirrer blades connected to the stirrer shaft and spaced apart from the stirrer motor.

A microwave oven can comprise a cooking compartment defined by a plurality of inward facing side walls, an inward facing top wall, and an inward facing bottom wall. The microwave can also include a microwave magnetron mounted within the microwave oven. The microwave can include a cavity plate assembly sealing off a stirrer cavity between the bottom wall and the cavity plate from a main portion of the cooking compartment. The microwave can further include a stirrer assembly as described above.

The stirrer shaft can extend from an area outside the stirrer cavity in fluid communication with ambient conditions, and into the stirrer cavity. The flow passage can place the stirrer cavity in fluid communication with ambient conditions. The stirrer motor can be positioned outside the stirrer cavity, while the stirrer blades and an outlet of the fluid passage are positioned inside the stirrer cavity.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
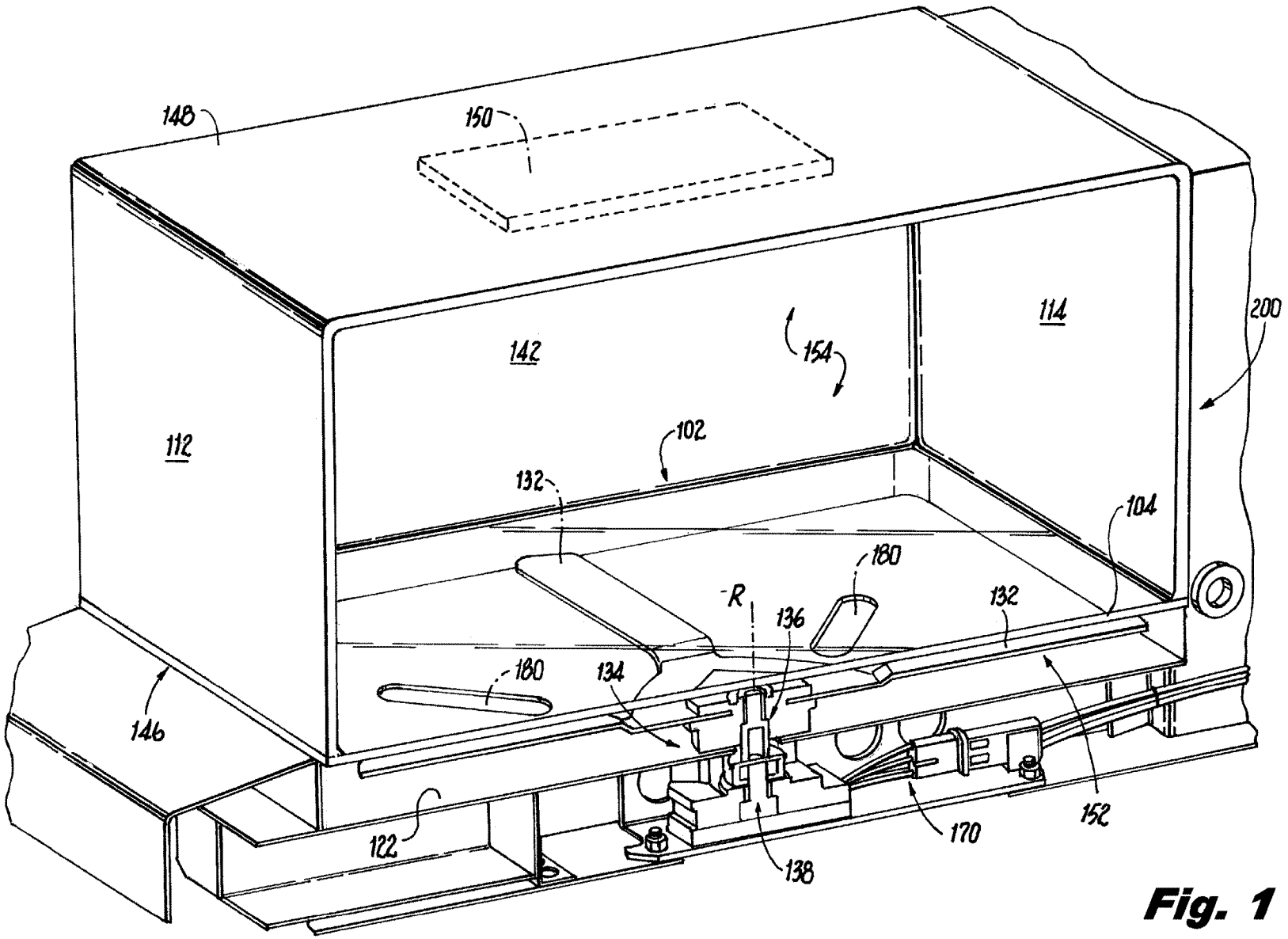
FIG. 1 is a schematic perspective view of an embodiment of a microwave oven constructed in accordance with the present disclosure, showing a stirrer assembly.

Reference will now be made to the drawings wherein like reference numerals identify similar structural features or aspects of the subject disclosure. For purposes of explanation and illustration, and not limitation, a partial view of an embodiment of a microwave oven in accordance with the disclosure is shown in FIG. 1 and is designated generally by reference character 100. Other embodiments of systems in accordance with the disclosure, or aspects thereof, are provided in FIG. 2, as will be described. The systems and methods described herein can be used to provide ventilation to a cooking compartment of a microwave oven.

Referring to FIG. 1, a microwave oven 100 can comprise a cooking compartment 200 defined by a plurality of inward facing side walls 112, 114, 142, an inward facing top wall 148, and an inward facing bottom wall 122. One of the shown inward facing walls 112, 114, 148, for example wall 112, may be an inward face of a door to the oven 100, so the wall 112 may have an open connection to the remaining walls. The microwave 100 can include a cavity plate assembly 146 (e.g. cavity plate 104 and cavity plate seal 102) sealing off a stirrer cavity 152 of the cooking compartment 200. The stirrer cavity 152 can be defined between the bottom wall 122 and the cavity plate 104, sealed off from a main portion 154 of the cooking compartment 200. The microwave 100 can further include a stirrer assembly 170. The microwave 100 can also include a microwave magnetron 150 mounted above the top wall 148 and/or the magnetron 150 can be mounted below the bottom wall 122. When the magnetron 150 is mounted below the bottom wall 122, electromagnetic (EM) radiation can be fed into the stirrer cavity 152 through feed ports 180 in bottom wall 122 so that the radiation can be randomly deflected by stirrer blades 132 for even cooking. It should be appreciated by those skilled in the art that a similar construction may be present above the top wall 148 for a top mounted magnetron 150, though such a construction is not shown in the drawings.

Figure 2:
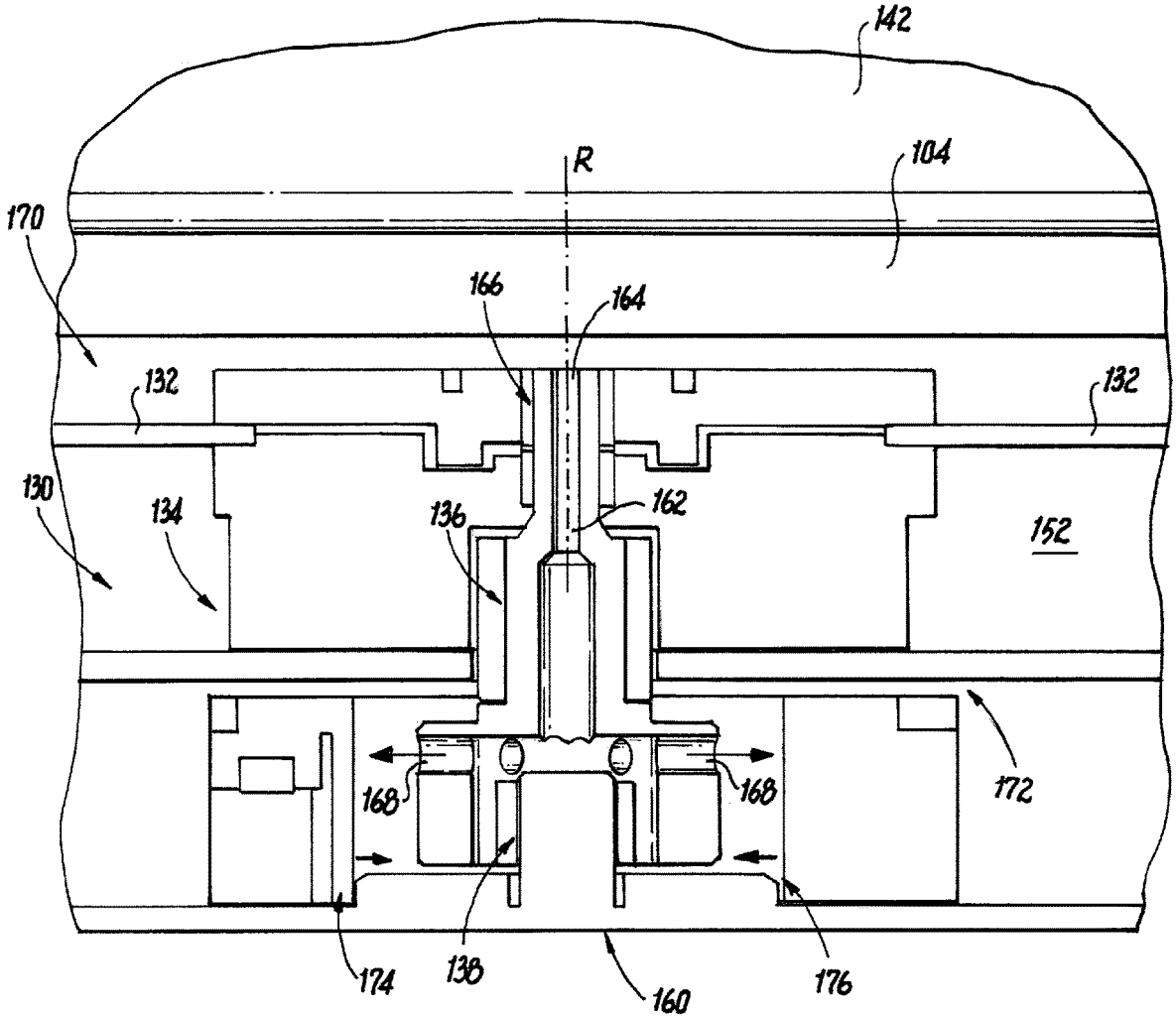
FIG. 2 is a schematic cross sectional view of the stirrer assembly of FIG. 1, showing a ventilation path.

As shown in FIGS. 1-2, the stirrer assembly 170 for the microwave oven 100 can include the stirrer shaft 134, a stirrer motor 138 connected to the first end 160 of the shaft body 136, and a set of stirrer blades 132 connected to the stirrer shaft 136 and spaced apart from the stirrer motor 138. The stirrer assembly 170 can also include cover 172.

Referring to FIG. 2, the stirrer shaft 134 can include a shaft body 136 configured to connect between the stirrer motor 138 on a first end 160 of the shaft body 136 and a set of stirrer blades (e.g. blades 132) spaced apart from the stirrer motor 138. The stirrer shaft body 136 can also include a flow passage 162 for equalizing pressure in the sealed stirrer cavity 152 of the microwave oven 100.

The flow passage 162 can include an outlet 164 at a second end 166 of the stirrer motor opposite the first end 160. The outlet 164 can open in an axial direction defined by an axis of rotation R of the shaft body 136. The flow passage 162 can also include at least one inlet 168 spaced apart from the outlet 164. In embodiments, the at least one inlet 168 can be closer to the second end 166 than to the first end 160 of the shaft body 136. Each of the at least one inlets 168 can open in a radial direction relative to the axis of rotation. It should be appreciated that although the inlets 168 are called an "inlets" the outlet 164 is called "outlet" herein, this is with reference to flow going into the stirrer cavity 152 from ambient to equalize the pressure inside the stirrer cavity 152 when ambient pressure increases. However, when ambient pressure decreases, the flow will be reversed, and the inlet/outlet designations could be reversed, for example outlet 164 can become an inlet, while inlets 168 may become outlets. The same can be said for openings 174 and 176 described below.

In embodiments, the stirrer shaft 134 can extend from an area outside the cooking compartment 100 (e.g. below bottom wall 122) in fluid communication with ambient conditions through flow passage 162. The cover 172 can encase as least the first end 160 of the shaft body 136. As shown in FIG. 2, the cover can include openings 174, 176 to allow flow passage 162 to fluidically connect the stirrer cavity 152 and the ambient conditions for flow between the stirrer cavity 152 and ambient conditions through the stirrer shaft 134. Thus, the flow passage 162 can place the stirrer cavity 152 in fluid communication with ambient conditions, for example for pressure equalization between the main portion 154 of the cooking compartment 200 and the stirrer cavity 152. In embodiments, the stirrer motor 138 can be positioned outside the stirrer cavity 152 while the stirrer blades 132 and the outlet 164 of the fluid passage 162 are positioned inside the cavity 152.

Conventionally, any pressure increase in the stirrer cavity 152 was handled by a failing seal around the cavity plate. However, it has been shown that air can leak out of the stirrer cavity 152 through the corners of a seal. However, improved sealing systems, such as cavity plate seal assembly 146 cause stirrer cavity 152 to become airtight, increasing the risk of cavity plate displacement. When the main portion 154 of the cooking compartment 200 is airtight from cavity plate seal assembly 146, increasing air pressure within the stirrer cavity 152 may displace the cavity plate 104. Increased air pressure can be caused by changing cabin pressure during flight, or temperature increase within the stirrer cavity 152 during cooking. If the cavity plate 104 becomes dislodged, fluids may leak into the stirrer cavity 152 causing equipment failure. The air pressure within the stirrer compartment 152 therefore needs to be ventilated, while the EM radiation from the magnetron 150 needs to be contained.

The methods and systems of the present disclosure, as described above and shown in the drawings, provide for improved ventilation within an aircraft microwave oven 100, so that air can flow through the stirrer shaft 134 while still containing the EM radiation. While the apparatus and methods of the subject disclosure have been shown and described, those skilled in the art will readily appreciate that changes and/or modifications may be made thereto without departing from the scope of the subject disclosure.

What is claimed is:

1. A stirrer shaft for a microwave oven, the stirrer shaft comprising:

a shaft body configured to connect between a stirrer motor on a first end of the shaft body and a set of stirrer blades spaced apart from the stirrer motor, wherein the shaft body includes a flow passage therethrough for equalizing pressure in a sealed stirrer cavity of the microwave oven.

2. The stirrer shaft as recited in claim 1, wherein the flow passage includes an outlet at a second end of the stirrer motor opposite the first end.

3. The stirrer shaft as recited in claim 2, wherein the outlet opens in an axial direction defined by an axis of rotation of the shaft body.

4. The stirrer shaft as recited in claim 2, wherein the flow passage includes at least one inlet spaced apart from the outlet.

5. The stirrer shaft as recited in claim 3, wherein the at least one inlet is closer to the first end than to the second end.

6. The stirrer shaft as recited in claim 1, wherein each of the at least one inlets opens in a radial direction relative to the axis of rotation.

7. A stirrer assembly for a microwave oven, the stirrer assembly comprising:

stirrer shaft as recited in claim 1;

a stirrer motor connected to a first end of the shaft body; and a set of stirrer blades connected to the shaft body and spaced apart from the stirrer motor.

8. The stirrer assembly as recited in claim 7, wherein the flow passage includes an outlet at a second end of the stirrer motor opposite the first end, wherein the outlet opens in an axial direction defined by an axis of rotation of the shaft body, wherein the flow passage includes at least one inlet spaced apart from the outlet, wherein the at least one inlet is closer to the first end than to the second end, and wherein each of the at least one inlets opens in a radial direction relative to the axis of rotation.

9. A microwave oven comprising:

a cooking compartment defined by a plurality of inward facing side walls, an inward facing top wall, and an inward facing bottom wall;

a microwave magnetron mounted within the microwave oven;

a cavity plate assembly sealing off a stirrer cavity between the bottom wall and the cavity plate from a main portion of the cooking compartment; and a stirrer assembly as recited in claim 7, wherein the shaft body extends from an area outside the stirrer cavity in fluid communication with ambient conditions, and into the stirrer cavity, wherein the flow passage places the stirrer cavity in fluid communication with ambient conditions.

10. The microwave oven as recited in claim 9, wherein the stirrer motor is positioned outside the stirrer cavity and wherein the stirrer blades and an outlet of the fluid passage are positioned inside the stirrer cavity.

11. The microwave oven as recited in claim 9, wherein the flow passage includes an outlet at a second end of the stirrer motor opposite the first end.

12. The microwave oven as recited in claim 11, wherein the outlet opens in an axial direction defined by an axis of rotation of the shaft body.

13. The microwave oven as recited in claim 11, wherein the flow passage includes at least one inlet spaced apart from the outlet.

14. The microwave oven as recited in claim 13, wherein the at least one inlet is closer to the first end than to the second end.

15. The microwave oven as recited in claim 9, wherein each of the at least one inlets opens in a radial direction relative to the axis of rotation.

* * * * *